US007278515B2

(12) United States Patent
Moser et al.

(10) Patent No.: US 7,278,515 B2
(45) Date of Patent: Oct. 9, 2007

(54) FOLDABLE SCAFFOLD

(75) Inventors: Gregory C. Moser, Columbus, IN (US); Paul F. Meyers, Fishers, IN (US)

(73) Assignee: Cosco Management, Inc., Wilmington, DE (US)

( * ) Notice: Subject to any disclaimer, the term of this patent is extended or adjusted under 35 U.S.C. 154(b) by 510 days.

(21) Appl. No.: 10/813,297

(22) Filed: Mar. 30, 2004

(65) Prior Publication Data

US 2005/0029049 A1 Feb. 10, 2005

Related U.S. Application Data

(60) Provisional application No. 60/493,671, filed on Aug. 8, 2003.

(51) Int. Cl.
*E04G 1/34* (2006.01)
*E06C 1/00* (2006.01)
*A47B 3/083* (2006.01)

(52) U.S. Cl. ..... 182/152; 108/169; 297/423.41; 182/28; 182/33

(58) Field of Classification Search ..... 182/152, 182/28, 33; 108/169, 167; 297/423.39, 297/423.41

See application file for complete search history.

(56) References Cited

U.S. PATENT DOCUMENTS 1,209,421 A * 12/1916 Ferguson ..... 108/168
2,709,631 A * 5/1955 Covucci ..... 108/36
2,730,417 A * 1/1956 Mitchell ..... 108/169
2,811,400 A * 10/1957 James ..... 108/38
2,831,741 A * 4/1958 Wilson ..... 108/169
3,080,833 A * 3/1963 Risdall ..... 108/169
3,080,834 A * 3/1963 Risdall ..... 108/169
3,276,401 A * 10/1966 Wilson et al. ..... 108/169
3,557,720 A * 1/1971 Blink et al. ..... 108/169
3,700,072 A 10/1972 Lovett
3,884,160 A * 5/1975 Gutierrez ..... 108/169
4,047,594 A 9/1977 Eisenberg
4,241,808 A 12/1980 Middleton et al.
4,298,096 A 11/1981 Prior
4,570,752 A 2/1986 Chapman et al.
4,640,385 A 2/1987 Underhill
4,645,162 A 2/1987 Roy et al.
4,690,248 A 9/1987 Killeen
4,823,913 A 4/1989 Riegel, Jr.
4,880,080 A 11/1989 Brockman
5,082,249 A 1/1992 Havlovitz
5,096,019 A 3/1992 Kelsay
5,758,744 A 6/1998 Forino
5,865,269 A 2/1999 Eskesen
5,954,156 A 9/1999 Cooke
6,000,345 A * 12/1999 Gillotti ..... 108/36
6,209,683 B1 4/2001 Holtz
6,427,804 B1 8/2002 Lazarus
6,454,050 B2 9/2002 Gibson et al.
6,752,091 B2 * 6/2004 Glover et al. ..... 108/168
2002/0166725 A1 11/2002 Gulledge

* cited by examiner

*Primary Examiner*—Hugh B. Thompson, II
(74) *Attorney, Agent, or Firm*—Barnes & Thornburg LLP

(57) ABSTRACT

A foldable scaffold is convertible between a use position and a folded position. In the use position, the scaffold may be used to support one or more people standing thereon. In the folded position, the scaffold may be more compact and easy to carry or store.

29 Claims, 13 Drawing Sheets

FIG. 7
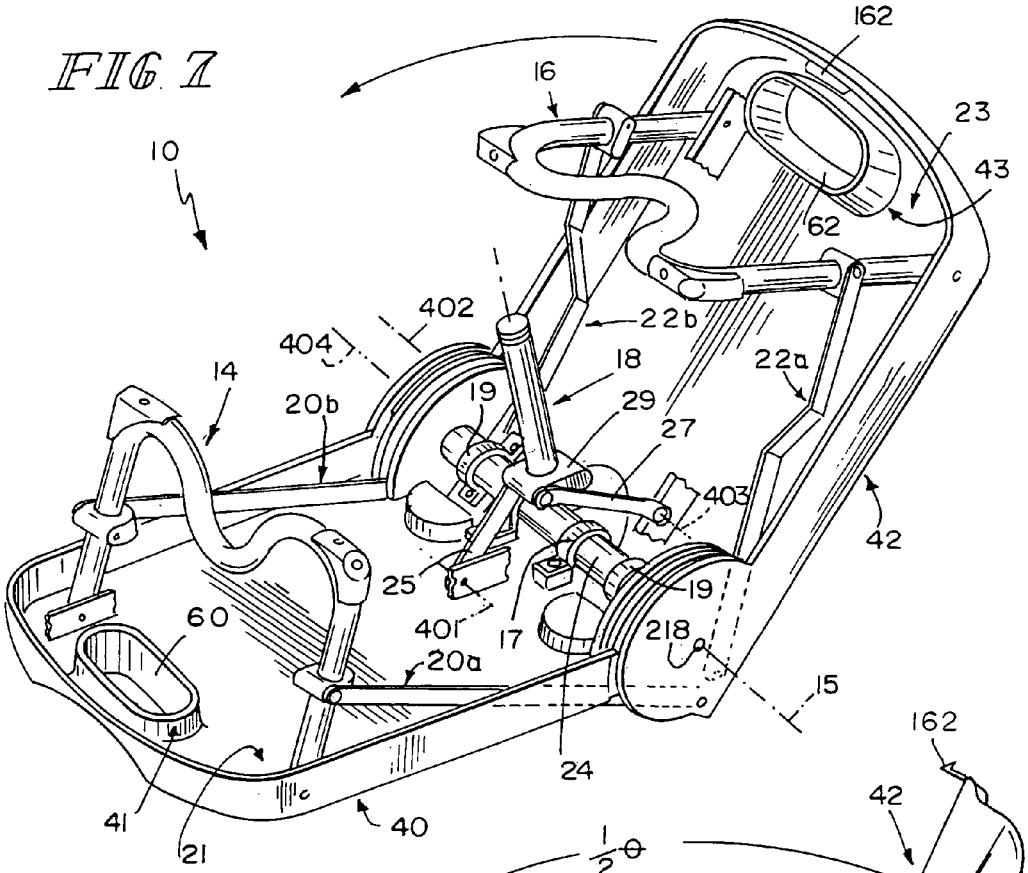
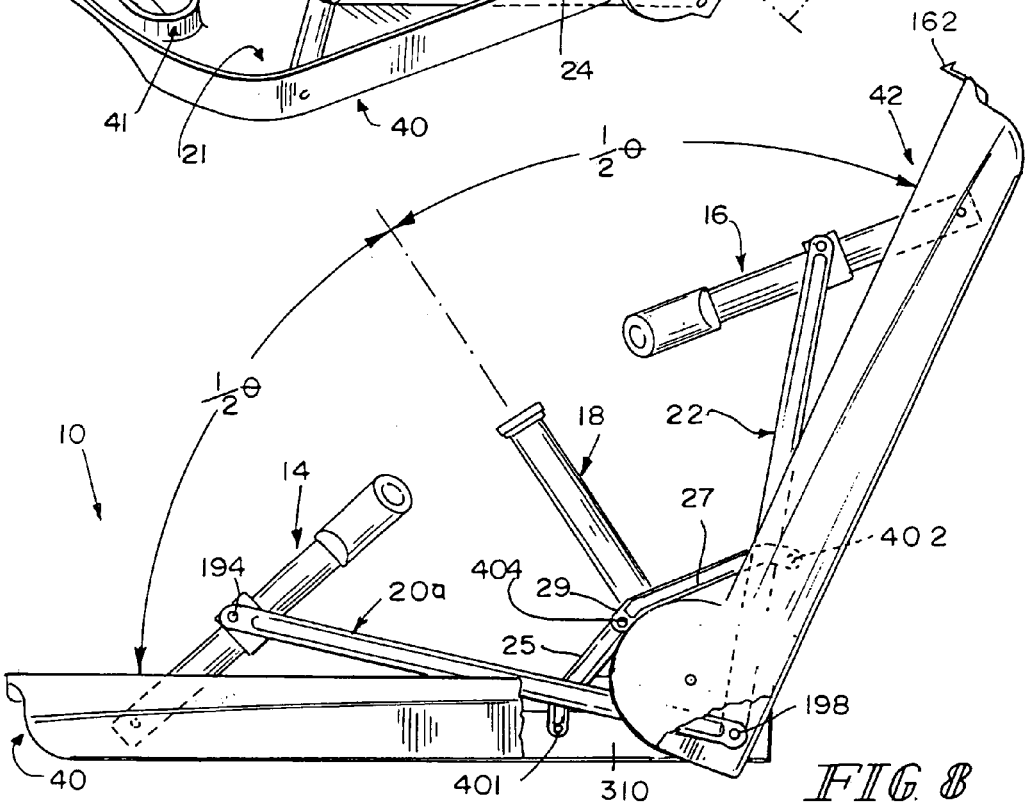
FIG. 8

FOLDABLE SCAFFOLD

This application claims priority under 35 U.S.C. § 119(e) to U.S. Provisional Application Ser. No. 60/493,671, filed Aug. 8, 2003, which is expressly incorporated by reference herein.

BACKGROUND

The present disclosure relates to scaffolds and, in particular, to foldable scaffolds.

Scaffolds are useful to individuals where extra elevation may be useful in performing a task, such as, for example, painting, cleaning, installing, repairing or maintaining an elevated area, item or structure. Once the task is completed, it may be useful to be able to move the scaffold readily to another location.

SUMMARY

The present disclosure relates to a foldable scaffold convertible between a use position and a folded position. The scaffold comprises a foldable floor and pivotable legs for supporting the foldable floor at an elevated position when the scaffold is in the use position. Leg mover links are provided to pivot the legs relative to the floor in response to folding and unfolding of the foldable floor.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIGS. 6, 7, 9, and 11 show a folding sequence for the scaffold shown in FIGS. 1–5 (with substantial portions of the bottom grid removed for clarity) as it is folded from the unfolded, use position shown in FIG. 6 to the folded, collapsed position shown in FIG. 11;

FIG. 6 is a perspective view of the underside of the scaffold in FIGS. 1–5 in its unfolded, use position before a user begins to fold the scaffold for transit or storage showing a first leg pivotably coupled to a first floor section of the scaffold (on the left side of FIG. 6), a second leg pivotably coupled to a second floor section of the scaffold (on the right side of FIG. 6), and a center leg coupled to an axle and located at a junction between the first and second floor sections;

FIG. 7 is a view similar to FIG. 6 of the scaffold in a partly folded position showing folding of the first leg toward the first floor section under the control of two first leg mover links coupled at an outer end to the first leg and at an inner end to the second floor section and showing folding of the second leg toward the second floor section under the control of two second leg mover links coupled at an outer end to the second leg and at an inner end to the first floor section;

FIG. 8 is a side elevation view of the partly folded scaffold of FIG. 7;

FIG. 9 is a perspective view similar to FIG. 7 showing further folding movement of the second floor section toward the first floor section;

FIG. 11 is a side elevation view similar to FIG. 10 and reduced in size showing the scaffold in a fully folded position wherein the second floor section mates with the first floor section to store the folded first, second, and center legs (shown in phantom) in a compartment formed between the floor sections;

DETAILED DESCRIPTION

An illustrative embodiment of a foldable scaffold 10 in accordance with the present disclosure, which is convertible between an unfolded or use position and a folded or collapsed position, is provided in FIGS. 1–8. In the use position, shown, for example, in FIG. 1, the scaffold 10 may be used to support the weight of one or more people standing thereon. In the folded position, shown, for example, in FIG. 2, the scaffold 10 may be more compact and easy to carry or store and is configured to provide a carrying handle 30. A foldable scaffold 510 in accordance with another embodiment is shown in FIGS. 15–25.

Figure 3:
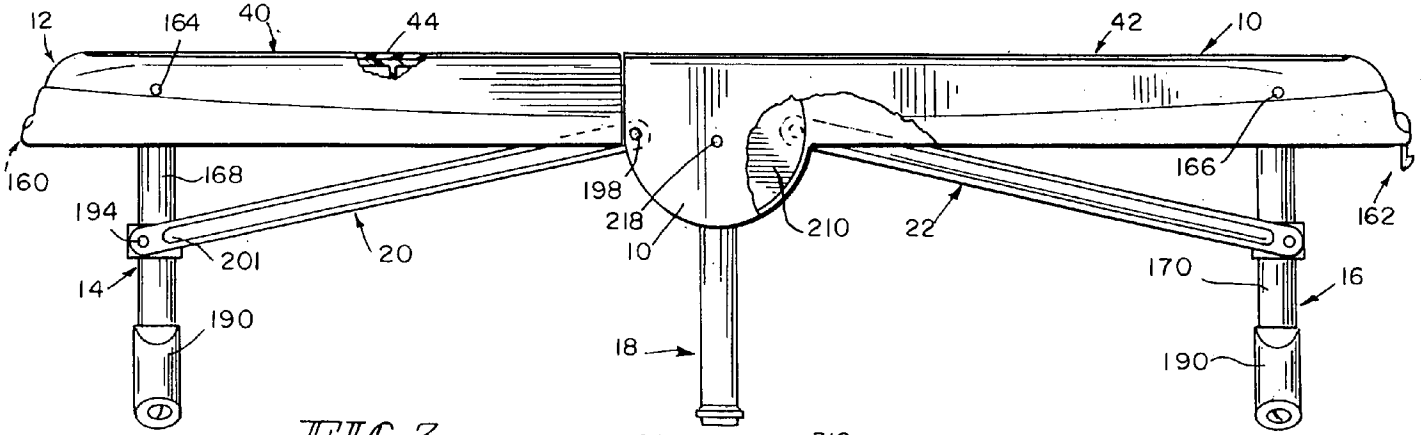
FIG. 3 is a side elevation view of the unfolded scaffold shown in FIG. 1.
Figure 4:
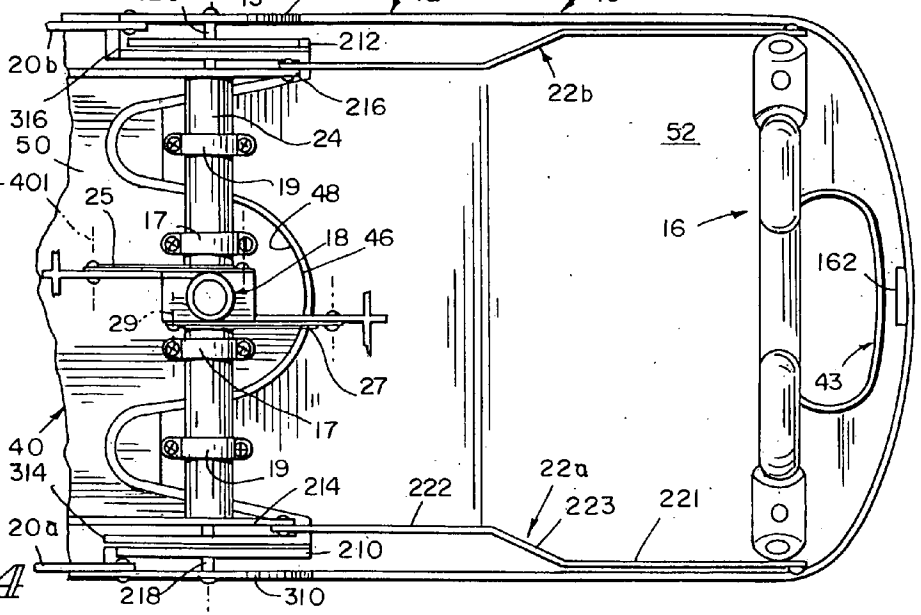
FIG. 4 is a partial bottom view of the scaffold shown in FIG. 3 (with substantial portions of a bottom grid removed for clarity)
Figure 3A:
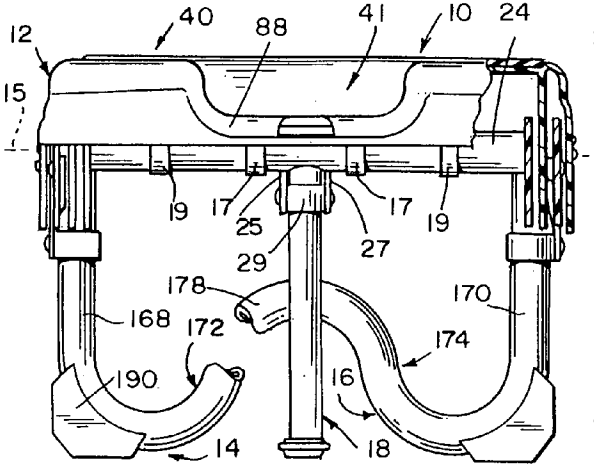
FIG. 3*a* is a "left-side" end view of the unfolded scaffold of FIG. 3, with portions broken away.
Figure 5:
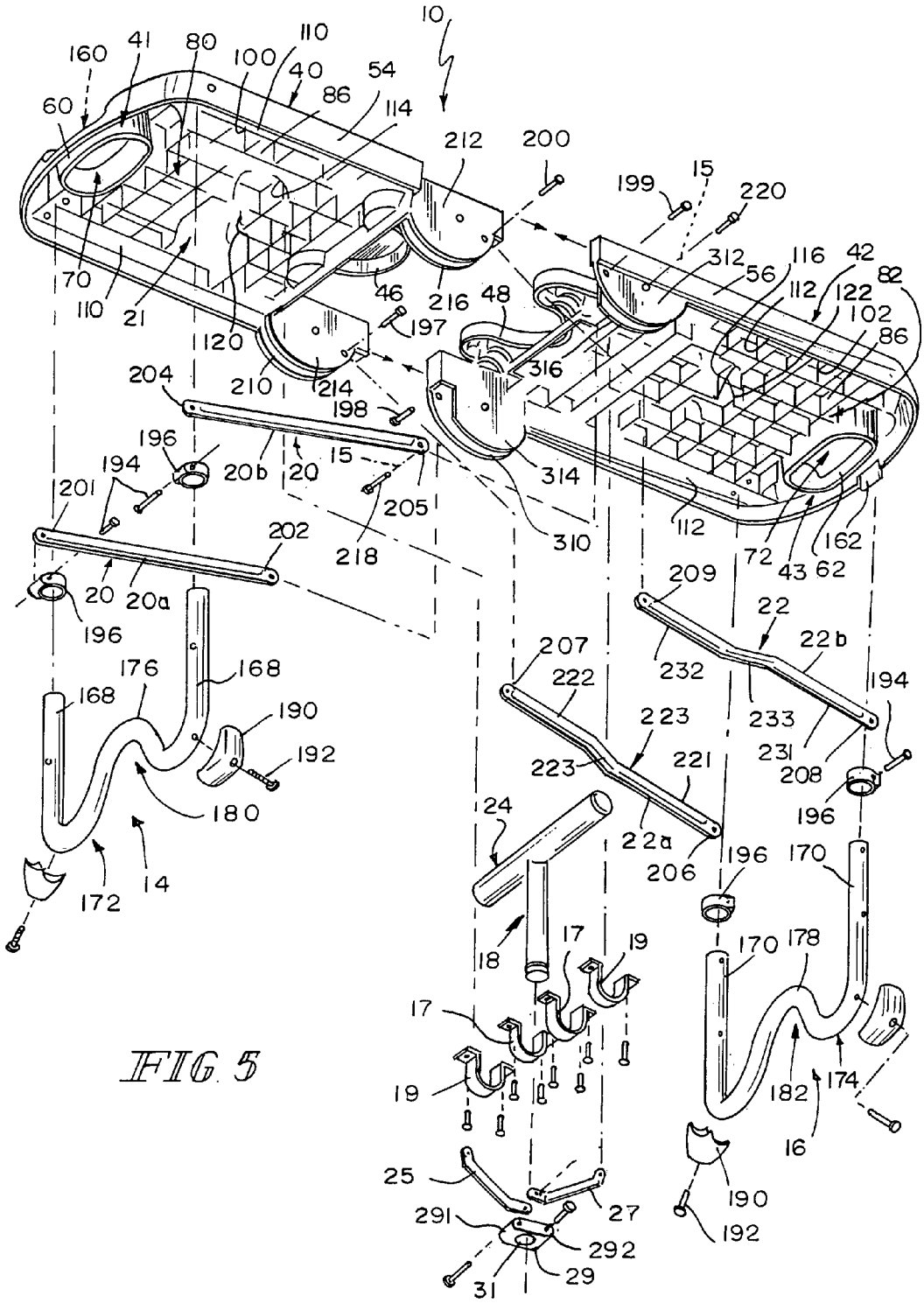
FIG. 5 is an exploded perspective assembly view of the components included in the scaffold shown in FIGS. 1–4.
Figure 6:
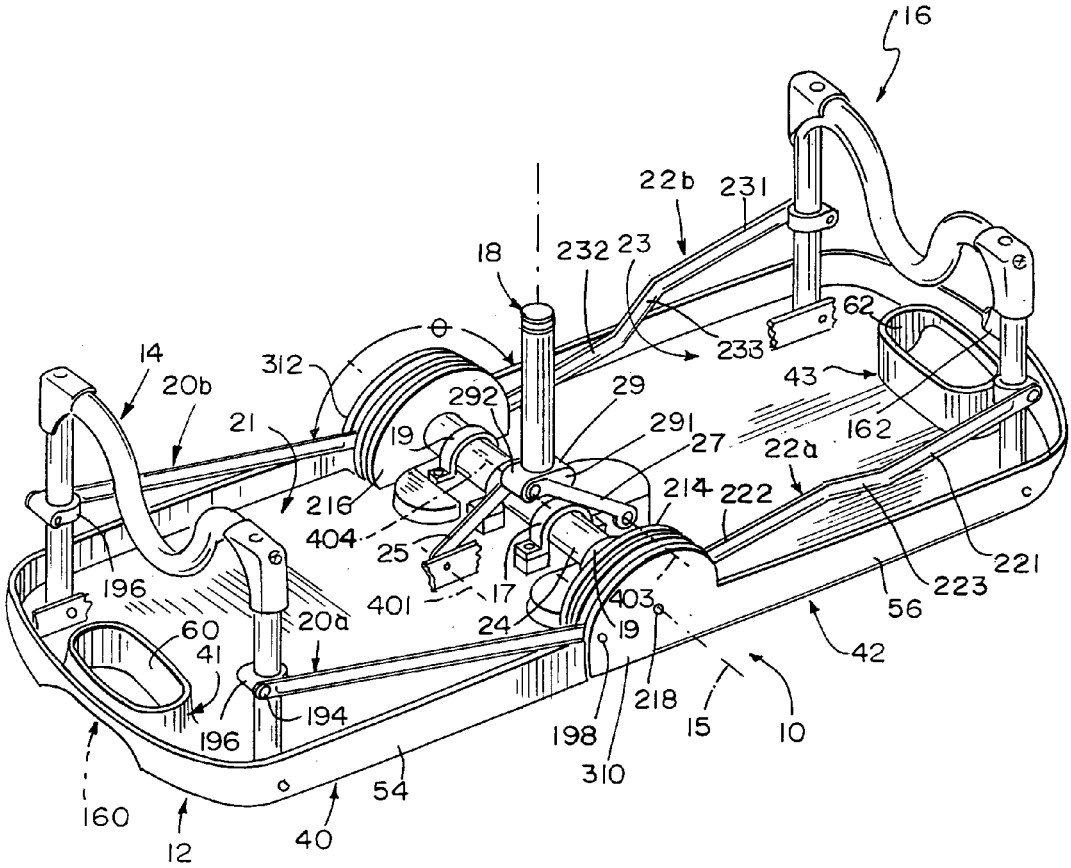
Figure 9:
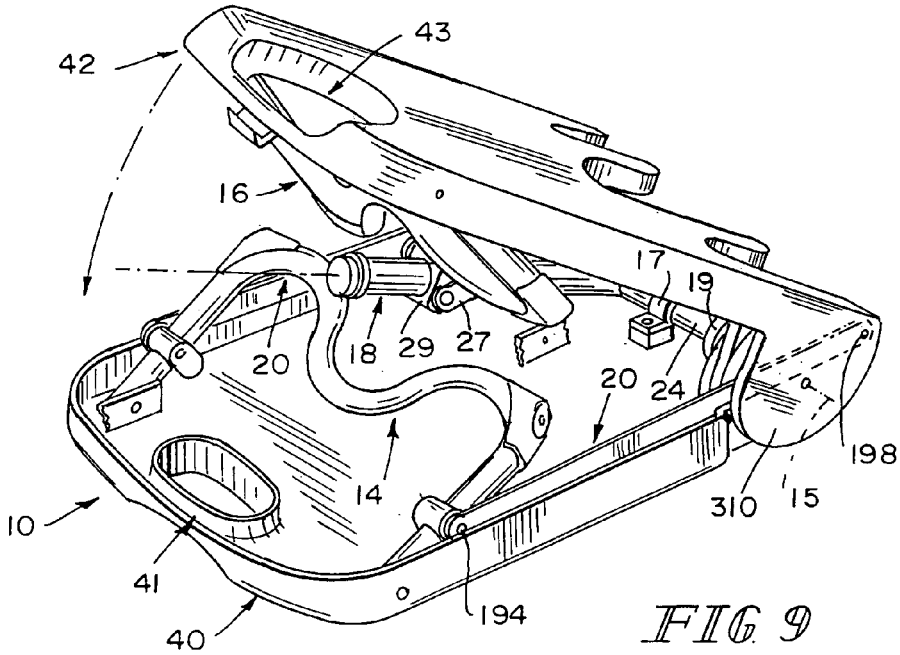
Figure 10:
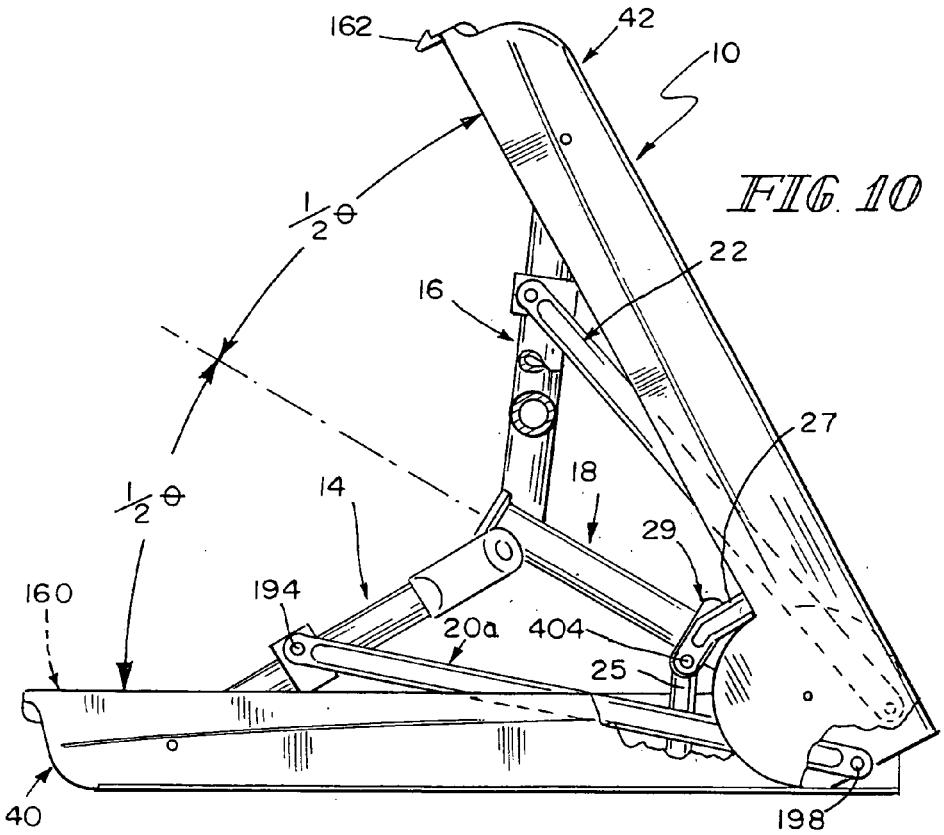
FIG. 10 is a side elevation view of the partly folded scaffold of FIG. 9.

In the illustrative embodiment, for example, the scaffold 10 comprises a foldable floor 12 adapted to support a person thereon when scaffold 10 is unfolded to assume the use position, a first leg 14, a second leg 16, and a center leg 18 as shown, for example, in FIGS. 3, 5, and 6. First leg 14 is mounted for pivotable movement on a first floor section 40 of foldable floor 12. Second leg 16 is mounted for pivotable movement on a companion second floor section 42 of foldable floor 12. Center leg 18 is mounted on a rotatable axle 24 of foldable floor 12 for pivotable movement at a junction between first and second floor sections 40, 42. Center leg 18 and axle 24 cooperate to form a T-shaped member and straps 17, 19 anchored by suitable fasteners are used to support axle 24 for rotation about axis 15 relative to first and second floor sections 40, 42 as suggested in FIGS. 4–7.

Figure 11:
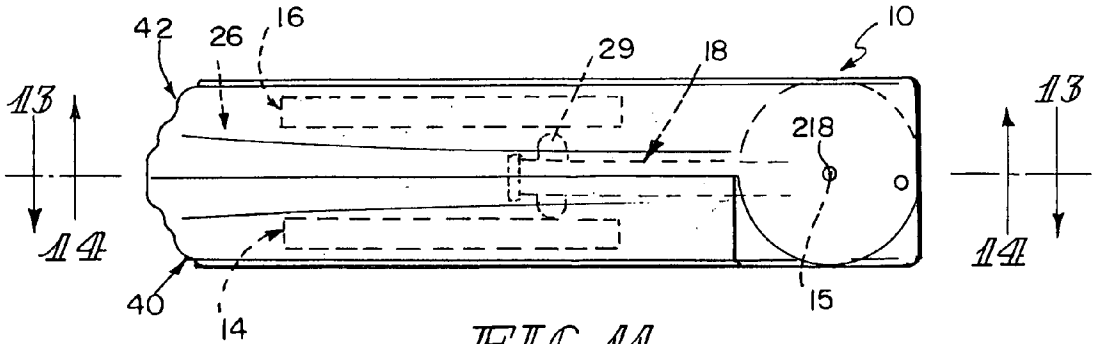
Figure 12:
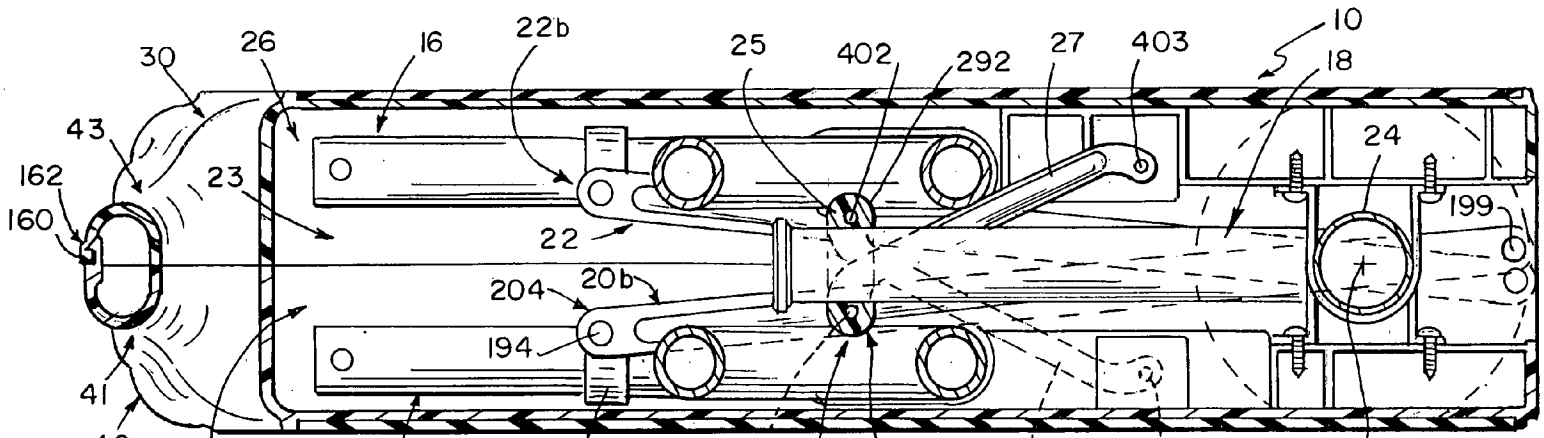
FIG. 12 is a sectional view taken along line 12—12 of FIG. 2.

A pair of first leg mover links 20 (e.g., 20*a* and 20*b*) is included in scaffold 10 to move (e.g., pivot) first leg 14 to a folded position inside an interior region 21 formed in first floor section 40 as shown in FIG. 12 whenever floor 12 is folded, for example, as suggested in the folding sequence shown in FIGS. 6, 7, 9, and 11. First leg mover links 20 also function to move first leg 14 to a floor-support position extending outside of the interior region 21 formed in first floor section 40 whenever floor 12 is unfolded to cause scaffold 10 to assume the unfolded, use position illustrated in FIGS. 3 and 6.

A pair of second leg mover links 22 (e.g., 22*a* and 22*b*) is included in scaffold 10 to move (e.g., pivot) second leg 16 to a folded position inside an interior region 23 formed in second floor section 42 as shown in FIG. 12 whenever floor 12 is folded as suggested, for example, in the folding sequence shown in FIGS. 6, 7, 9, and 11. Second leg mover links 22 also function to move second leg 16 to a floor-support position extending outside of the interior region 23 formed in second floor section 42 whenever floor 12 is unfolded to cause scaffold 10 to assume the unfolded, use position illustrated in FIGS. 3 and 6.

A pair of center leg mover links 25, 27 and a slide block 29 cooperate to move center leg 18 to assume a stored position in a space 26 defined between first and second floor sections 40, 42 whenever scaffold 10 is folded, for example, as suggested in the folding sequence shown in FIGS. 6, 7, 9, and 11 and in the views illustrated in FIGS. 8 and 10–12. Slide block 29 is formed to include a central aperture 31 (see FIG. 5) sized to receive center leg 18 for sliding movement therein as suggested in FIGS. 6–12. During movement of center leg 18 between the use position shown, for example, in FIG. 6 and the stored position shown, for example, in FIG. 12, third leg 18 is constrained to move so as to always bisect an included angle θ defined between first and second floor sections 40, 42 as suggested, for example, in FIGS. 3, 8, 10, and 12, in part, owing to cooperation between center leg 18, slide block 29, and center leg mover links 25, 27.

Figure 1:
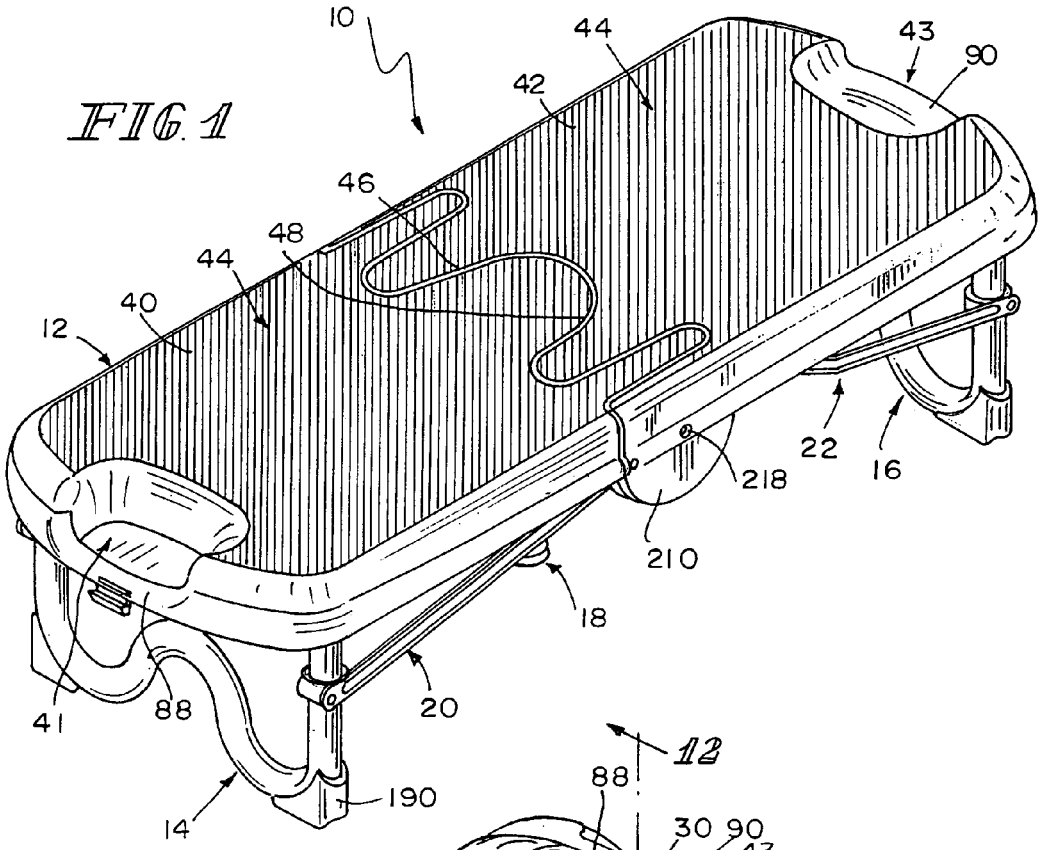
FIG. 1 is a perspective view of a foldable scaffold in accordance with an embodiment of the present disclosure in an unfolded, use position.

First, second, and center legs 14, 16, and 18 are configured to Support floor 12 at an elevated position when scaffold 10 is in the unfolded, use position, as shown in FIGS. 1 and 3. Legs 14, 16, and 18 are sized and located to be received by a leg-receiving cavity or compartment 26 defined by floor 12 (and interior regions 21 and 23 of first and second floor sections 40 and 42) when scaffold 10 is in the folded position, as suggested, for example, in FIGS. 11 and 12. Center leg 18 is disposed between first and second legs 14 and 16, as shown best in FIGS. 3 and 6. Center leg 18 is fixed to an axle 24 that is journaled to rotate about axis 15 relative to first and second floor sections 40, 42. First, second, and center legs 14, 16, and 18 may be positioned at any other suitable locations in accordance with other embodiments.

Figure 2:
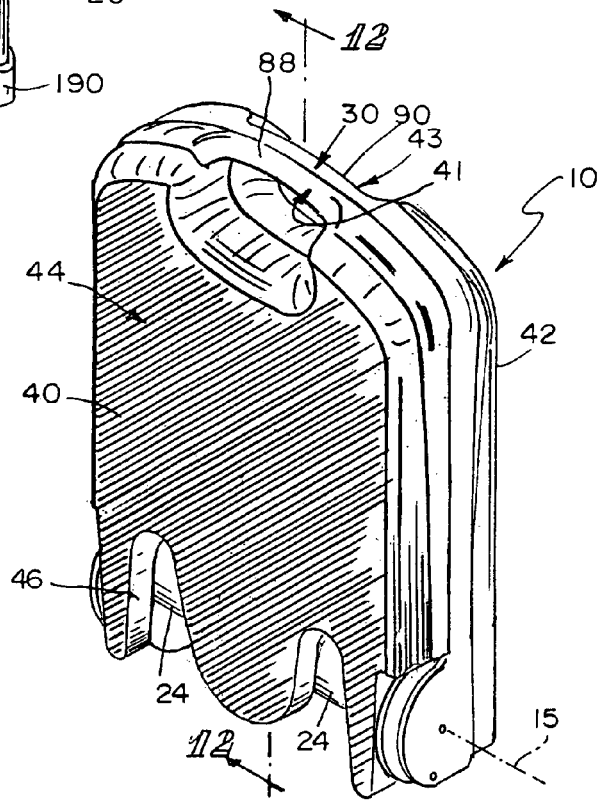
FIG. 2 is a perspective view of the scaffold shown in FIG. 1 after it has been folded to assume a folded, collapsed position and showing a carrying handle associated with the folded scaffold.

Scaffold 10 forms a handle 30 when scaffold 10 is moved to assume the folded, use position as suggested, for example, in FIG. 2. One handle portion 41 is formed in first floor section 40 and another handle portion 43 is formed in second floor section 42 as suggested in FIGS. 5 and 6. Handle portions 41, 43 are arranged to cooperate to form handle 30 when scaffold 10 is moved to assume the folded position as shown in FIG. 2.

First and second floor sections 40 and 42 are coupled for pivotable movement relative to one another about axis 15 and together form a person-support surface 44 (for supporting a person thereon) when scaffold 10 is in the use position, as shown in FIGS. 1 and 3, and define a leg-receiving cavity 26 when scaffold 10 is in the folded position, as suggested in FIG. 12. As suggested in FIGS. 4 and 5, each floor section 40 and 42, respectively, includes serpentine mating edges 46 or 48, a bottom 50 or 52 having a peripheral wall 54 or 56, an upstanding lip 60 or 62 near its distal end defining a hole 70 or 72, and rigidifying grids 80 or 82 formed by a plurality of intersecting walls 86. Holes 70 and 72 of the floor sections 40 and 42 align with each other when scaffold 10 is in the folded position to help form carrying handle 30, as suggested in FIG. 2. Peripheral walls 54 and 56 include respective cut-out portions 88 or 90 at handle 30 to facilitate ready grasping by a person desiring to carry folded scaffold 10 as suggested in FIGS. 1 and 2.

Illustrated mating edges 46 and 48 are in the form of upstanding walls and have mating serpentine configurations. As suggested in FIG. 13, mating edge 46 of first floor section 40 includes a center peninsula or tongue 92 and defines a pair of elongated openings 94 disposed about center peninsula 92. As suggested in FIG. 14, mating edge 48 of second floor section 42 defines a central void 96 for receiving center peninsula 92 and includes spaced-apart first and second peninsulas or tongues 98 configured to be received by elongated openings 94 formed in first floor section 40. Mating edges 46 and 48 may have any other serpentine or other configurations in accordance with other embodiments.

The illustrated peripheral walls 54 and 56 and grids 80 and 82 of floor sections 40 and 42 respectively define W-shaped channels 100 and 102 for receiving W-shaped first and second legs 14 and 16 when scaffold 10 is in the folded position (as suggested in FIG. 5), and thus the configurations of channels 100 and 102 complement the configurations of first and second legs 14, 16. Channels 100 and 102 may have any suitable configurations depending on the configurations of the respective first and second legs 14 and 16, and may be a portion or section of cavity 26. In the illustrative embodiment, for example, each channel 100 and 102 respectively includes two leg channels 110 or 112 and a connecting channel 114 or 116 connecting the two leg channels. Each of the connecting channels 114 and 116 respectively includes a channel bend 120 or 122 to complement the configuration of first or second legs 14 and 16 described herein. Channels 100 and 102 face each other when scaffold 10 is in the folded position. Channels 100 and 102 may be formed in any suitable manner. For example, walls 86 forming grids 80, 82 on the bottom of floor 12 may be omitted or rounded out in the injection molds to form the channels 100 and 102. An example of such a construction is provided in FIG. 6 (note that in FIGS. 4, 6, 7, 9, and 12, each rigidifying grid 80, 82 was removed virtually in its entirety for clarity as to other components). Any other suitable structure may be included to define the channels 100 and 102, in accordance with other embodiments.

Figure 13:
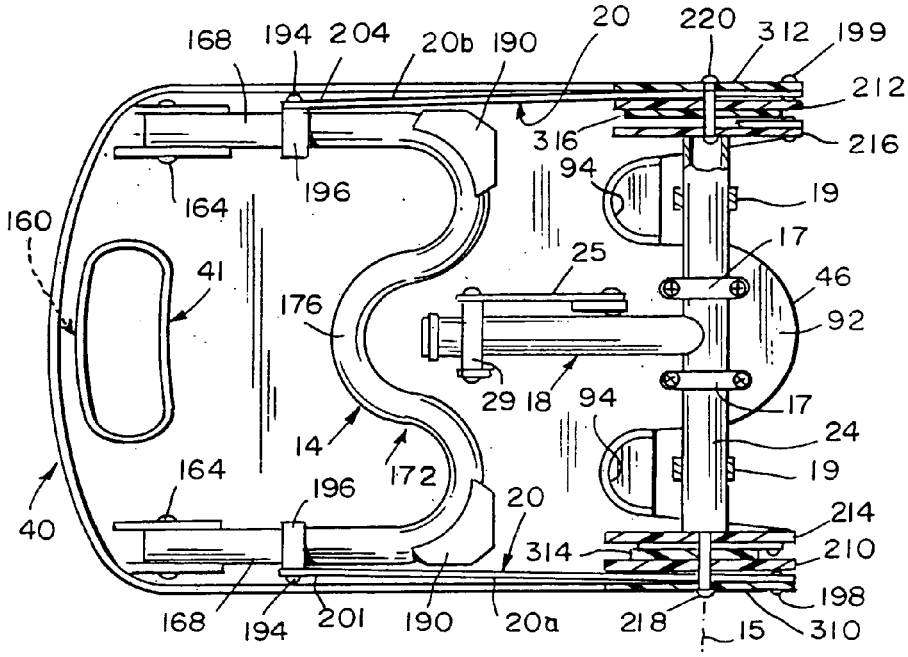
FIG. 13 is a sectional view taken along line 13—13 of FIG. 11 showing the underside of the first floor section of the folded scaffold and showing the "W-shaped" first leg, the two first leg mover links coupled at an outer end to the first leg and at an inner end to the second floor section, and the center leg coupled to the axle.

First floor section 40 includes first and second outer flanges 210, 212 arranged to lie in spaced-apart relation to one another as suggested in FIGS. 4, 5, and 13 to extend toward second floor section 42. First floor section 40 also includes first and second inner flanges 214, 216 arranged to lie in spaced-apart relation to one another (in a space between first and second outer flanges 210, 212) as suggested in FIGS. 4, 5, and 13 also to extend toward second floor section 42. Axle 24 extends between first and second inner flanges 214, 216 as shown, for example, in FIG. 13. A first pivot pin 218 is coupled to first outer and inner flanges 210, 214 as suggested in FIGS. 5 and 13. Also, a second pivot pin 220 is coupled to second outer and inner flanges 212, 216. Openings 94 and center peninsula 92 lie between first and second inner flanges 214, 216 as suggested in FIG. 13.

Figure 14:
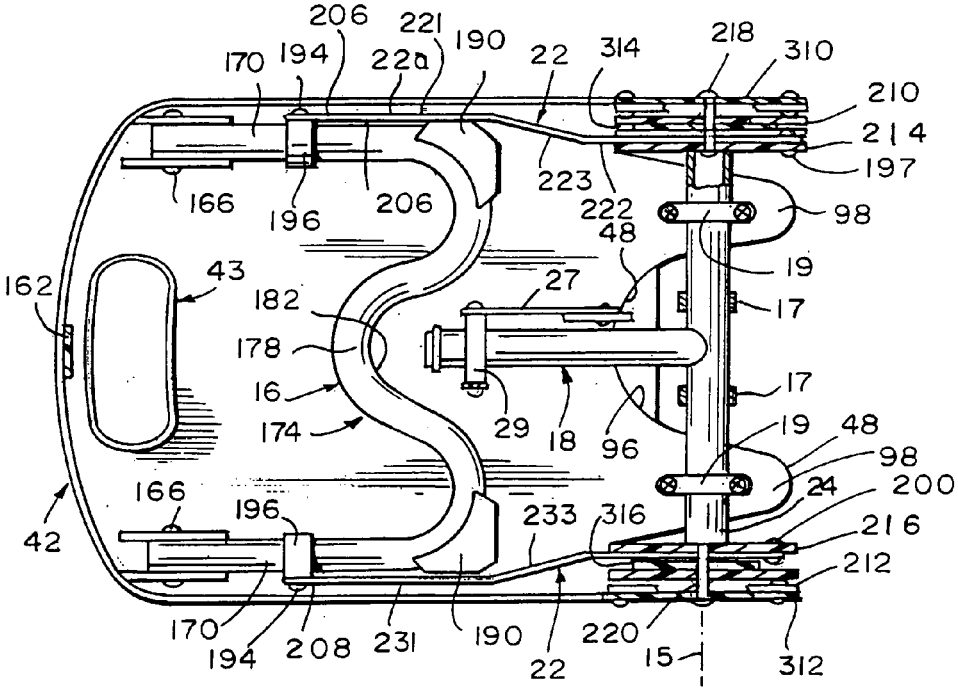
FIG. 14 is a sectional view taken alone line 14—14 of FIG. 11 showing the underside of the second floor section of the folded scaffold and showing the "W-shaped" second leg, the two second leg mover links coupled at an outer end to the second leg and at an inner end to the first floor section.

Second floor section 42 includes first and second outer flanges 310, 312 arranged to lie in spaced-apart relation to one another as suggested in FIGS. 4, 5, and 14. Second floor section 42 also includes first and second inner flanges 314, 316 arranged to lie in spaced-apart relation to one another (in a space between first and second outer flanges 310, 312) as suggested in FIGS. 4, 5, and 14 also to extend toward second floor section 42.

First outer and inner flanges 210, 214 of first floor section 40 "intermesh" with first outer and inner flanges 310, 314 of second floor section 42 as suggested, for example, in FIGS. 4, 6, 13, and 14. Likewise, second outer and inner flanges 212, 216 of first floor section 40 intermesh with second outer and inner flanges 312, 316 of second floor section 42. First pivot pin 218 passes through apertures formed in outer flange 210 and inner flange 314 to help establish pivot axis 15. Second pivot pin 220 passes through apertures formed in outer flange 212 and inner flange 316 to help establish pivot axis 15.

As suggested in FIG. 4, first outer and inner flanges 210, 214 of first floor section 40 cooperate to define a pocket therebetween receiving first inner flange 314 of second floor section 42 therein. Second outer and inner flanges 212, 216 of first floor section 40 cooperate to define a pocket therebetween receiving second inner flange 316 of second floor section 42 therein.

As also suggested in FIG. 4, first outer and inner flanges 310, 314 of second floor section 42 cooperate to define a pocket therebetween receiving first outer flange 210 of first floor section 40 therein. Second outer and inner flanges 312, 316 of second floor section 42 cooperate to define a pocket therebetween receiving second outer flange 212 of first floor section 40 therein.

First and second floor sections 40 and 42 may be releasably lockable to each other when scaffold 10 is in the folded position to releasably lock scaffold 10 in the folded position in any suitable manner. In the illustrated embodiment, for example, first floor section 40 defines a slot 160 adjacent hole 70 and second floor section 42 defines a flexible clasp 162 receivable by slot 160 to releasably lock clasp 162 to slot 160 of first floor section 40.

First, second, and center legs 14, 16, and 18 may be coupled to floor 12 at any suitable location. In the illustrative embodiment, for example, first leg 14 is coupled to first floor section 40 by a pair of pivot pins 164 as suggested in FIG. 13, second leg 16 is coupled to second floor section 42 by a pair of pivot pins 166 as suggested in FIG. 14, and center leg 18 is coupled to floor 12 as set forth herein between first and second legs 14, 16 and positioned at or near the center of floor 12.

In the illustrated embodiment of FIGS. 1–15, for example, each of first and second legs 14 and 16 has a circular cross section substantially along its expanse, and respectively includes a pair of parallel leg portions 168 or 170 and a serpentine-shaped connecting leg portion 172 or 174 that includes a bend 176 or 178 to define a void 180 or 182 for receiving third leg 18 as scaffold 10 is converted between the use and folded positions. Thus, in the illustrated embodiment, each of first and second legs 14, 16 is somewhat "W-shaped." Bends 176 and 178 provide clearance between first and second legs 14 and 16 and third leg 18 as first and second floor sections 40 and 42 pivot relative to each other. A pair of traction footings 190 is secured to each of first and second legs 14, 16 by fasteners 192 as suggested in FIGS. 5, 13, and 14.

In the illustrative embodiment, first leg mover links 20 pivotably connect first leg 14 to second floor section 42 and second leg mover links 22 pivotably connect second leg 16 to first floor section 40. Thus, leg mover links 20 and 22 extend past or across the mating edges 46 and 48 to pivotably connect first leg 14 with second floor section 42 and second leg 16 with first floor section 40. Leg mover links 20 and 22, together with the serpentine configurations of mating edges 46 and 48, cause first and second legs 14 and 16 to pivot relative to floor 12 as first floor section 40 and second floor section 42 pivot relative to each other and as scaffold 10 is converted between the use and folded positions as suggested, for example, in FIGS. 6–12.

First leg mover link 20*a* includes an outer end 201 pivotably coupled to a slide ring 196 by a pivot pin 194 and an inner end 202 pivotably coupled to first outer flange 310 of second floor section 42 by a pivot pin 198 as suggested in FIGS. 5 and 13. Pivot pin 198 extends through an aperture formed in first outer flange 310 as suggested in FIG. 5. Slide ring 196 (coupled to outer end 201) is formed to include a passageway receiving one of leg portions 168 of first leg 14 for sliding movement therein.

Second leg mover link 20*b* includes an outer end 204 pivotably coupled to a slide ring 196 by a pivot pin 194 and an inner end 205 pivotably coupled to second outer flange 312 of second floor section by a pivot pin 199 as suggested in FIGS. 5 and 13. Pivot pin 199 extends through an aperture formed in second outer flange 312 as suggested in FIG. 5. Slide ring 196 (coupled to outer end 204) is formed to include a passageway receiving the other of leg portions 168 of first leg 14 for sliding movement therein.

Second leg mover link 22*a* includes an outer end 206 pivotably coupled to a slide ring 196 by a pivot pin 194 and an inner end 207 pivotably coupled to a second inner flange 214 of first frame section 40 by a pivot pin 197 as suggested in FIGS. 5 and 14. Pivot pin 197 extends through an aperture formed in second inner flange 214 as suggested in FIG. 5. Slide ring 196 (coupled to outer end 206) is formed to include a passageway receiving one of leg portions 170 of second leg 16 for sliding movement therein. Second leg mover link 22*a* includes a straight outer section 221 comprising outer end 206, a straight inner section 222 comprising inner end 207 and parallel to outer section 221, and an angled, offset middle section 223 interconnecting outer and inner sections 221, 222 as suggested in FIGS. 4 and 5.

Second leg mover link 22*b* includes an outer end 208 pivotably coupled to a slide ring 196 by a pivot pin 194 and an inner end 209 pivotably coupled to a first inner flange 216 of first frame section 40 by a pivot pin 200 as suggested in FIGS. 5 and 14. Pivot pin 200 extends through an aperture formed in first inner flange 216 as shown in FIG. 14. Slide ring 196 (coupled to outer end 208) is formed to include a passageway receiving one of leg portions 168 of second leg 16 for sliding movement therein. Second leg mover link 22*b* includes straight outer section 231 comprising outer end 208, a straight inner section 232 comprising inner end 209 and parallel to outer section 231, and an angled, offset middle section 233 interconnecting outer and inner sections 231, 232 as suggested in FIGS. 4 and 5.

The illustrative embodiment of the present disclosure provides a scaffold 10 that can be converted readily to a folded position for ready transport or storage. In the folded position, first and second legs 14 and 16 are received by channels 100 and 102 of floor 12 and first, second, and center legs 14, 16, and 18 are thereby received by cavity 26 of floor 12 so that all or some of the legs 14, 16, and 18 are received by cavity 26, as suggested in FIGS. 11 and 12. First and second legs 14 and 16 pivot readily as scaffold 10 converts between the use and folded positions. In the folded position, scaffold 10 can be converted readily to the use position by, for example, pivoting movement of first and second floor sections 40, 42 away from one another.

Scaffold 10 is foldable along a center line between first and second floor sections 40, 42 and legs 14, 16, and 18 fold in and out driven automatically by a mechanical linkage. Legs 14, 16, and 18 and folds inside an envelope (e.g., cavity 26) of scaffold 10 when scaffold 10 is closed and legs 14, 16, and 18 unfold automatically when scaffold 10 is opened. Legs 14, 16, and 18 are driven mechanically by the folding and unfolding action of closing and opening scaffold 10 as suggested, for example, in FIGS. 6–12.

Movement of first leg unit 14 from the use position shown in FIG. 6 to the storage position shown in FIGS. 11 and 12 is initiated by pivoting second floor section 42 toward first floor section 40 owing to the use of first leg mover links 20 to link first leg 14 to second floor section 42. First leg mover links 20 are coupled at one end to first leg 14 and at an opposite end to pivot pins 198 or 199 coupled to second floor section 42. As second floor section 42 is pivoted toward first floor section 40 as suggested in FIG. 7, first leg mover links 20 are moved to pull first leg 14 in a pivoting motion downwardly and inwardly toward the underside of first floor section 40.

Movement of second leg 16 from the use position shown in FIG. 6 to the storage position shown in FIGS. 11 and 12 is initiated by pivoting first floor section 40 toward second floor section 42 owing to the use of second leg mover links 22 to link second leg 16 to first floor section 40. Second leg mover links 22 are coupled at one end to second leg 16 and at an opposite end to pivot pins 197 or 200 coupled to first floor section 40. As first floor section 40 is pivoted toward second floor section 42 as suggested in FIG. 7, second leg mover links 22 are moved to pull second leg 16 in a pivoting motion downwardly and inwardly toward the underside of second floor section 42.

As suggested in FIGS. 6–10, center leg 18 moves relative to slide block 29 and center leg mover links 25, 27 move relative to first and second floor sections 40, 42 so that center leg 18 is always aligned to bisect the included angle θ defined between first and second floor sections 40, 42 as those sections 40, 42 move relative to one another. Center leg mover link 25 is pivotably coupled at one end to first floor section 40 to pivot about axis 401 and at another end to a second side 292 of slide block 29 as shown best in FIGS. 4, 6, 7, and 12. Center leg mover link 27 is pivotably coupled at one end to second floor section 42 to pivot about axis 403 and at another end to a first side 291 of slide block 29 to pivot about axis 404 as also shown best in FIGS. 4, 6, 7, and 12. Slide block 29 is thus constrained by these center leg mover links 25, 27 to move toward and away from axle 24 as first and second floor sections 14, 16 pivot toward and away from one another about axle 24.

Figure 15:
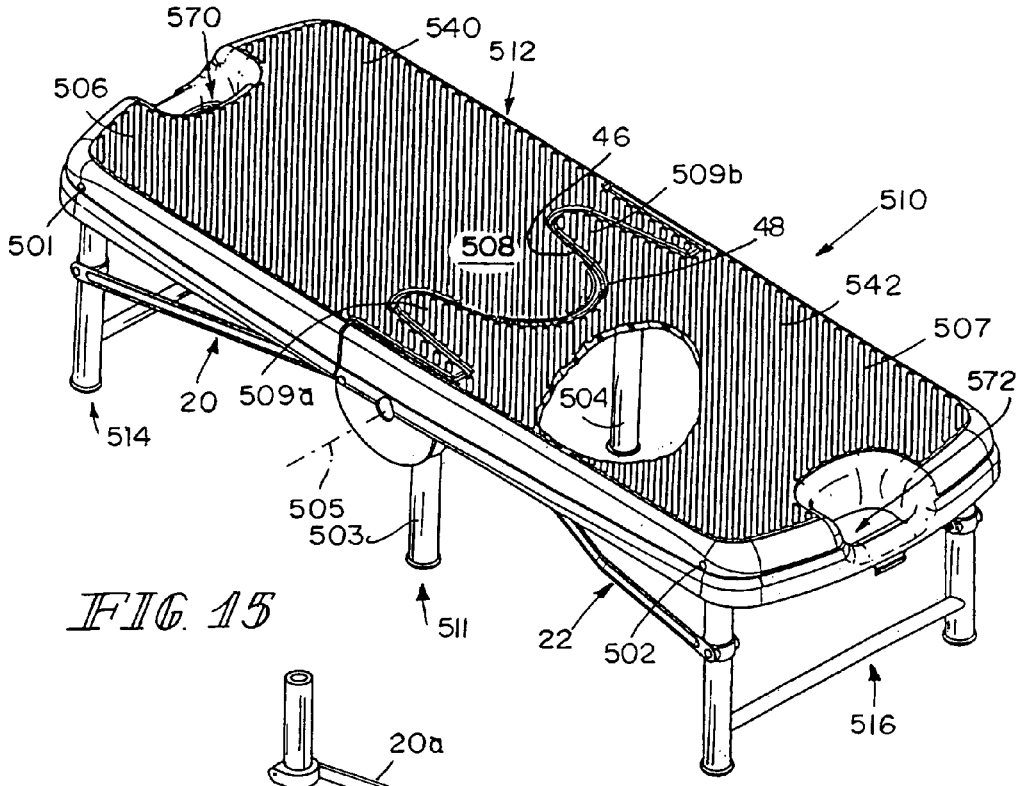
FIG. 15 is a perspective view of a foldable scaffold in accordance with another embodiment of the present disclosure in an unfolded, use position.
Figure 16:
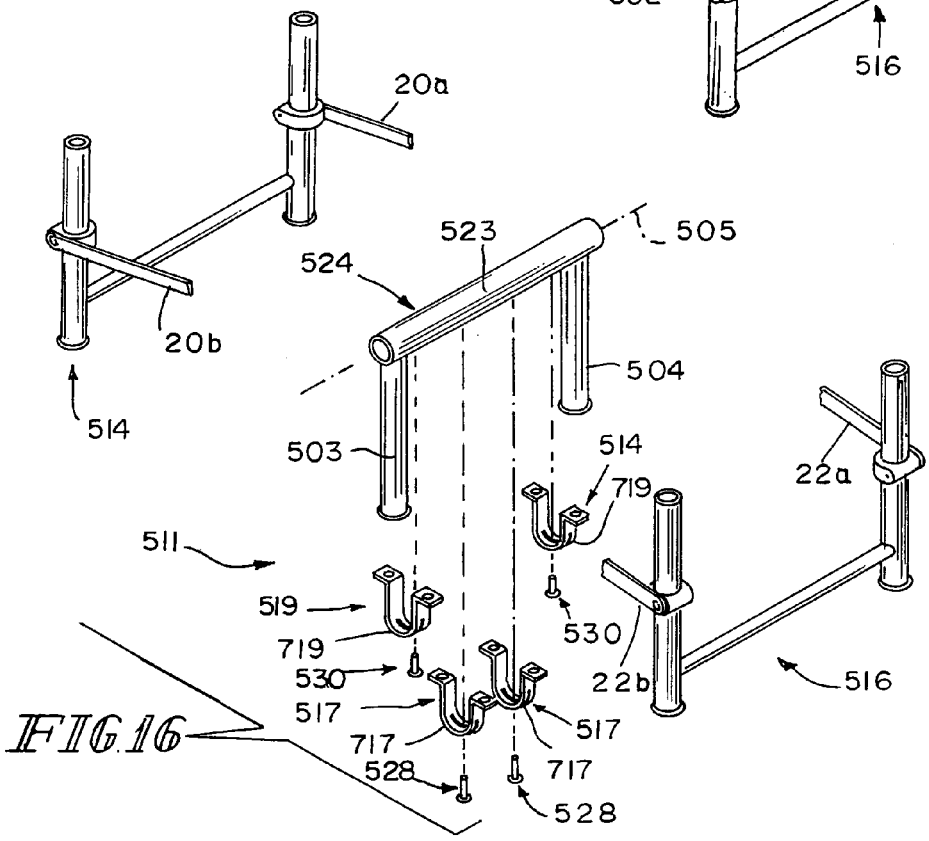
FIG. 16 is a perspective view of some of the components included in the foldable scaffold of FIG. 15 showing (from left to right) the first leg, portions of the first leg mover links, the axle rod and two center legs coupled to the axle rod, two adjacent first axle mounts, two spread-apart second axle mounts, four rod posts sized to pass through slots formed in the axle mounts and take root on the axle rod, portions of the second leg mover links, and the second leg.
Figure 17:
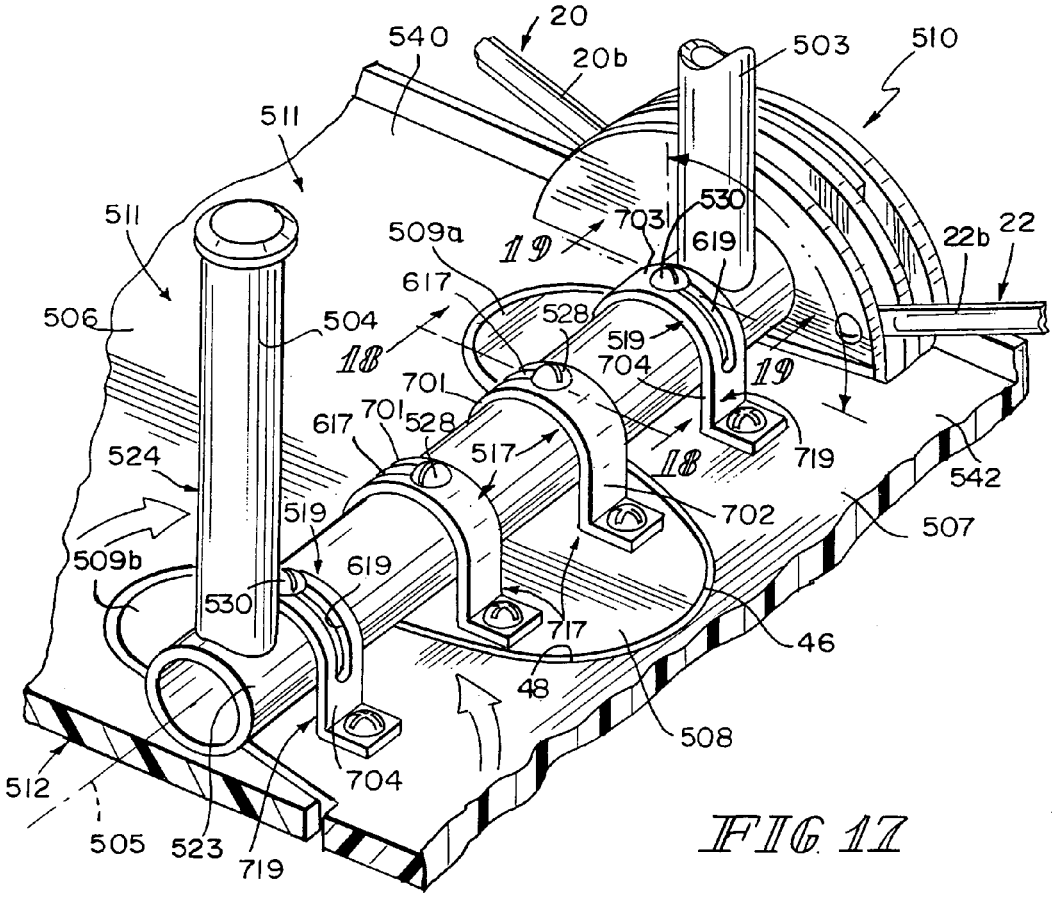
FIG. 17 is an enlarged perspective view of a portion of the underside of the foldable scaffold of FIG. 16 showing the axle mounts coupled to peninsulas included in the first and second floor sections and the axle rod extending across serpentine mating edges forming perimeter boundaries of the peninsulas of the first and second floor sections.
Figure 18:
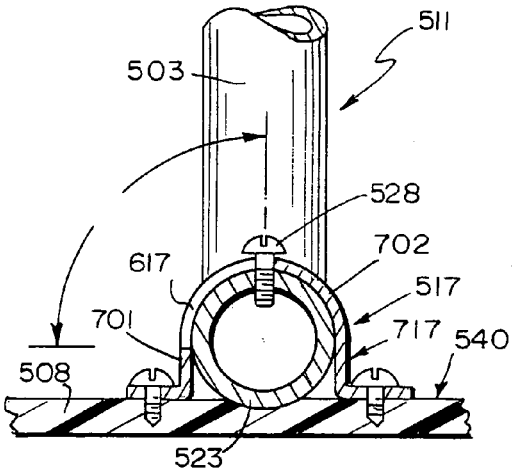
FIG. 18 is a sectional view taken along line 18—18 of FIG. 17.
Figure 19:
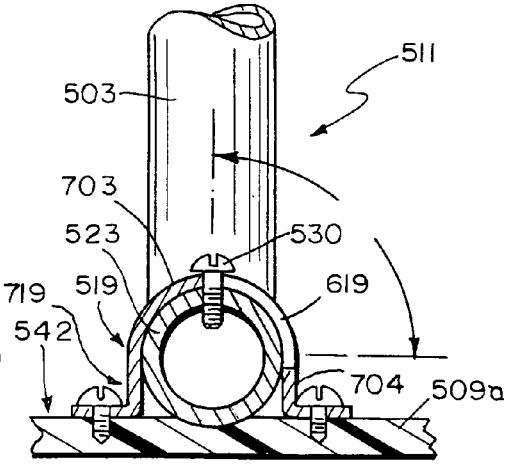
FIG. 19 is a sectional view taken along line 19—19 of FIG. 17.

A foldable scaffold 510 in accordance with another embodiment of the disclosure is shown in FIGS. 15–25. Leg structure included in scaffold 510 is shown in FIG. 16 and details of illustrative pivotable center floor elevator 511 are shown in FIGS. 17–19. An illustrative folding sequence of scaffold 510 is shown in FIGS. 20–24.

Figure 20:
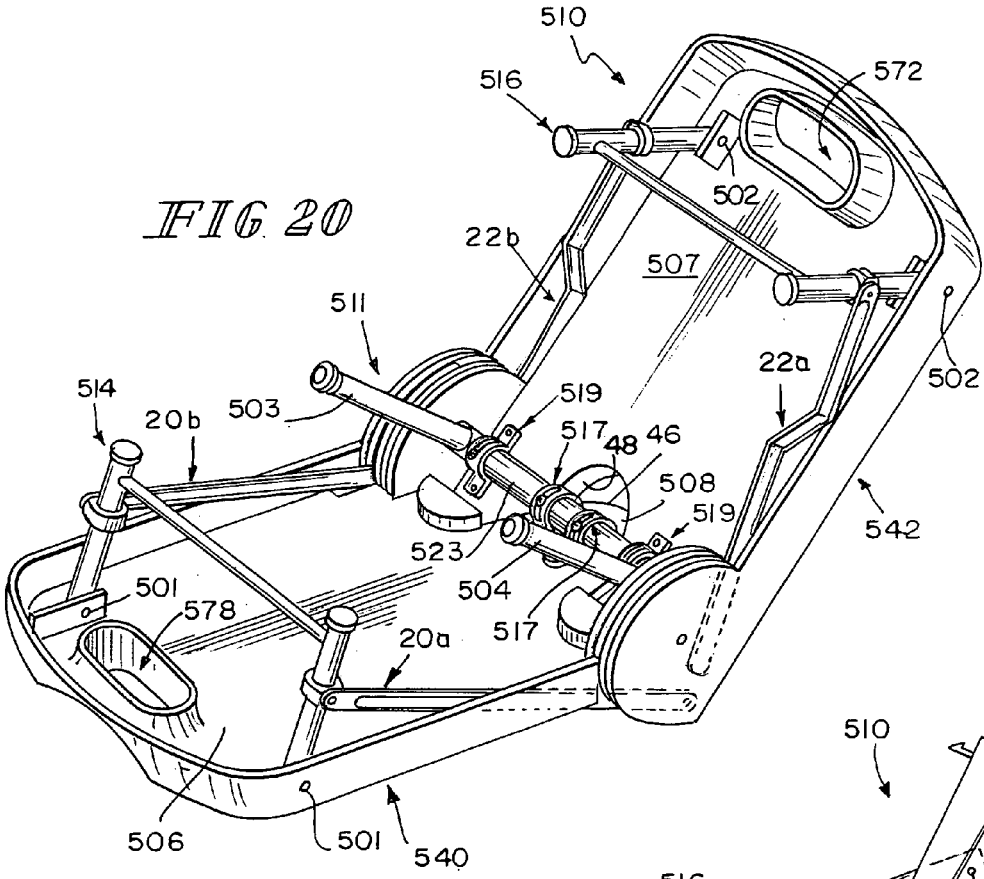
FIGS. 20–24 show a folding sequence for the scaffold shown in FIG. 16 (with the bottom grid removed for clarity) as it is folded from the unfolded, use position shown in FIG. 16 to the folded, collapsed position shown in FIG. 24.
Figure 21:
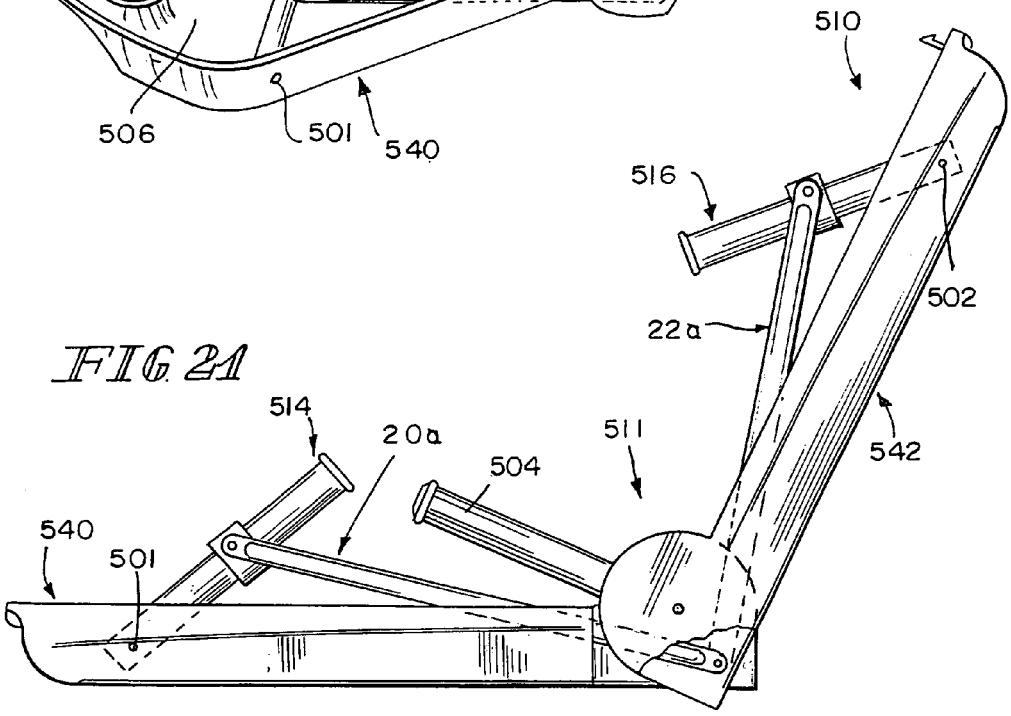
Figure 22:
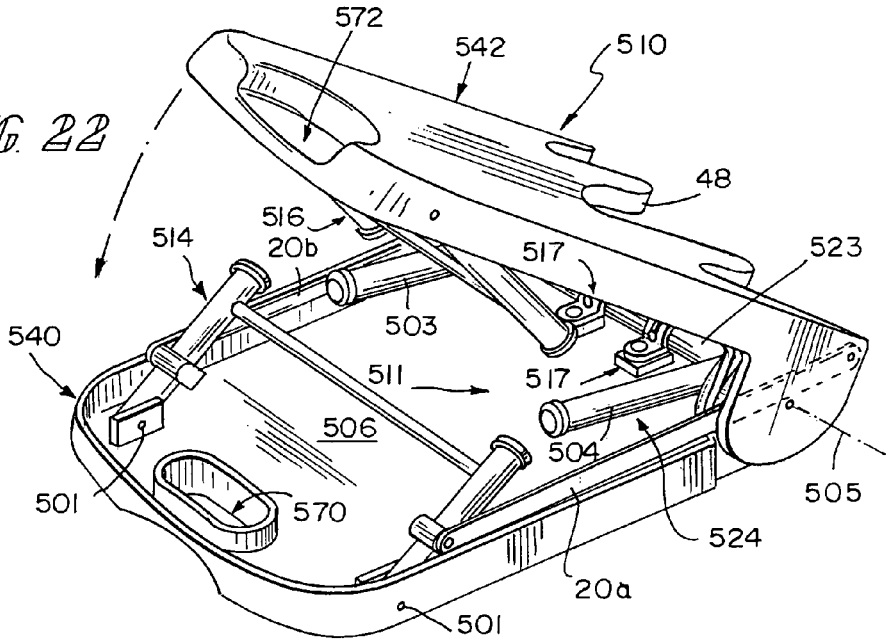
Figure 23:
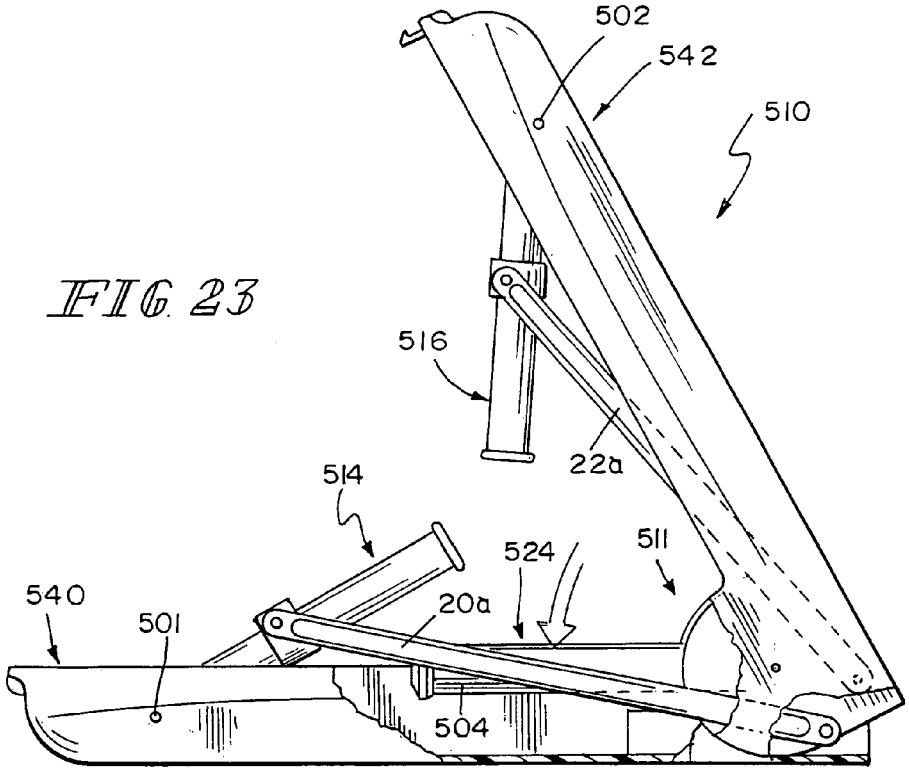
Figure 24:
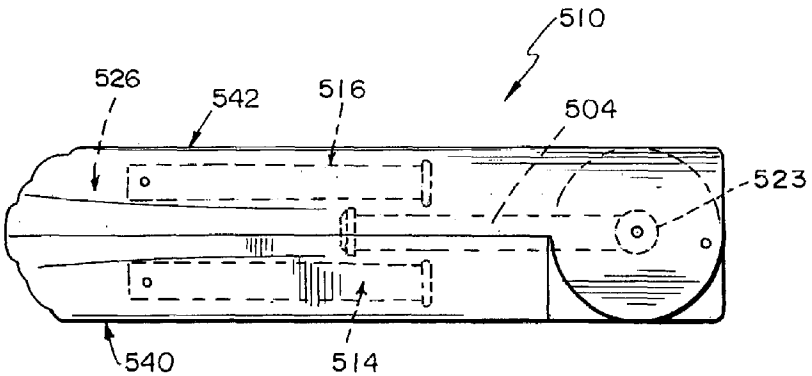

As shown, for example, in FIGS. 15 and 20, scaffold 510 comprises a foldable floor 512, a first leg 514, a second leg 516, and center floor elevator 511. First leg 514 is mounted for pivotable movement on a first floor section 540 of floor 12 and second leg 516 is mounted for pivotable movement on a second floor section 542 of floor 12. First leg 514 is coupled to first floor section 540 using pivot pins 501 and second leg 516 is coupled to second floor section 542 using pivot pins 502. Center floor elevator 511 is arranged to lie between first and second legs 514, 516 and includes an axle rod 523 and first and second center legs 503 and 504 coupled to axle rod 523 to form an axle 524 as suggested, for example, in FIGS. 16 and 17. Axle rod 523 is mounted to rotate about a longitudinal axis 505 during folding and unfolding of scaffold 510 so that center floor elevator 511 can be moved into a cavity 526 formed between first and second floor sections 540, 542 when scaffold 510 is folded as suggested, for example, in FIGS. 20–24.

First and second legs 540, 542 and center floor elevator 511 are configured to support floor 512 at an elevated position when scaffold 510 is in the use position and to be received by cavity 526 located between first and second floor sections 540, 542 when scaffold is in the folded position. Scaffold 510 also includes means for pivotably coupling first and second legs 514, 516 to floor 512 such that first and second legs 514, 516 pivot relative to floor 512 as first and second floor sections 540, 542 pivot relative to each other, as shown, for example, in FIGS. 20–24. The means for pivotably coupling first and second legs 514–516 to floor 512 comprises a plurality of leg mover links 20, 22 configured to pivot relative to floor 512 as first and second floor sections 540, 542 pivot relative to each other. Specifically, a pair of first leg mover links 20*a*, 20*b* pivotably couple first floor section 540 to second leg 516 and a pair of second leg mover links 22*a*, 22*b* pivotably couple second floor section 542 to first leg 514 such that first leg 514 pivots relative to first floor section 540 and second leg 542 pivots relative to second floor section 542 as first and second floor sections 540, 542 pivot relative to each other. The structure, function, and operation of mover links 20, 22 and the portions of floor 512 coupled to leg mover links 20, 22 are disclosed in connection with the discussion of the embodiment of FIGS. 1–14.

First floor section 540 has a first serpentine mating edge 46, as shown in FIGS. 15 and 17. Second floor section 542 has a second serpentine mating edge 48 that mates with the first serpentine mating edge 46 when scaffold 510 is converted to the use position.

Floor 512 further includes a pair of first axle mounts 517 coupled to first floor section 540 using suitable fasteners. Each first axle mount 517 is formed to include a first axle-receiving space 518. Floor 512 also includes a pair of second axle mounts 519 coupled to second floor section 542 using suitable fasteners. Each second axle mount 519 is formed to include a second axle-receiving space 520.

Floor 512 also includes an axle 524 having an axle rod 523 arranged to extend through first and second axle-receiving spaces 517, 519 and across first and second serpentine mating edges 46, 48, as shown, for example, in FIG. 17, to couple first floor section 540 to second floor section 542. This coupling establishes a pivot axis 305 to allow first and second floor sections 540, 542 to pivot relative to one another about pivot axis 505 as scaffold 510 is converted between the use and folded positions.

As shown best in FIG. 20, first floor section 540 has a body 506 coupled to first leg 514 and second floor section 542 has a body 507 coupled to second leg 516. First serpentine mating edge 46 defines a peninsula 508 extending from body 506 of first floor section 540 past pivot axis 505 toward body 507 of second floor section 516. Second serpentine mating edge 48 defines a pair of spaced-apart peninsulas 509*a*, 509*b* extending from body 507 of second floor section 542 past pivot axis 505 toward body 506 of first floor section 540. Second serpentine mating edge 48 of second floor section 542 is arranged to mate with first serpentine mating edge 46 of first floor section 540 when scaffold 510 is converted to the use position to cause peninsulas 508, 509, 509*b* of first and second floor sections 540, 542 to lie in interlocking "side-by-side" relation to one another. Each first axle mount 517 is coupled to peninsula 508 of first floor section 540. Each second axle mount 519 is coupled to one of peninsulas 509*a*, 509*b* of second floor section 542. Axle rod 523 is arranged to extend across peninsulas 508, 509*a*, 509*b* of first and second floor sections 540, 542, as shown, for example, in FIG. 17.

Figure 25:
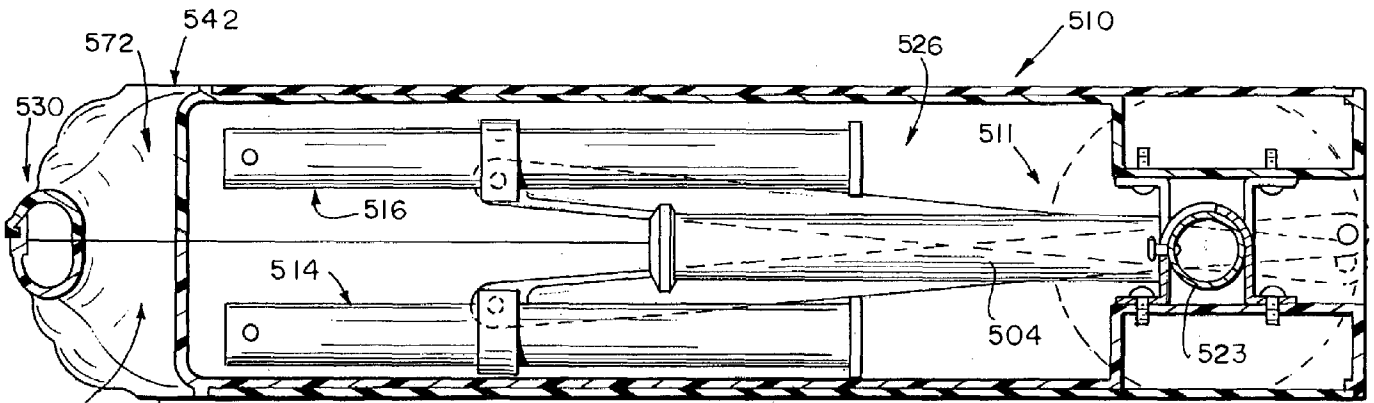
FIG. 25 is a sectional view similar to FIG. 12 taken of the scaffold of FIG. 16 in the folded, collapsed position.

First and second floor sections 540, 542 cooperate to form a carrying handle 530 when scaffold 510 is in the folded position, as suggested in FIG. 25. First floor section 540 defines a hole 570 and second floor section 542 defines a hole 572, as shown, for example, in FIGS. 15 and 20. The two holes 570, 572 align when scaffold is in the folded position to form handle 530.

Center floor elevator 511 is disposed between first and second legs 514, 516 and coupled to floor 512. Center floor elevator 511 cooperates with first and second legs 514, 516 to support first and second floor sections 540, 542 at an elevated position when scaffold 510 is in the use position and is received by cavity 26 when scaffold 520 is in the folded position. Center floor elevator 511 includes one center leg 503 coupled to one end of axle rod 523 and another center leg 504 coupled to an opposite end of axle rod 523 to cooperate with first, second, and center legs 514, 516, 503 to support first and second floor sections 540, 542 at an elevated position when scaffold 510 is in the use position and is received by cavity 26 when scaffold 510 is in the folded position.

Each first axle mount 517 is formed to include a curved first slot 617. Each second axle mount 519 is formed to include a curved second slot 619. Axle 524 includes an axle rod 523 coupled to center legs 503, 504 and arranged to extend through first and second axle-receiving spaces 518, 520 to allow relative motion between axle rod 523 and first and second axle mounts 517, 519. Axle 524 also includes first and second rod posts 528, 530 (e.g., threaded bolts). Each first rod post 528 is coupled to axle rod 523 and arranged to extend into a companion one of first slots 617 and to move therein during pivoting movement of first floor section 540 relative to the second floor section 542. Each second rod post 530 is coupled to axle rod 523 and arranged to extend into a companion one of second slots 619 and move therein during pivoting movement of first floor section 540 relative to second floor section 542. First and second slots 617, 619 are arranged to receive rod posts 528, 530 to "allow"/"pull" central floor elevator 511 into its unfolded position during motion of first floor section 540 relative to second floor section.

Each first axle mount 517 includes a U-shaped strap 717 including a first quarter section 701 facing toward first floor section 540 and a second quarter section 702 mating with first quarter section 701 and facing toward second floor section 542. First slot 617 is formed in first quarter section 701 of U-shaped strap 717 of each first axle mount 517. Second axle mount 519 includes a U-shaped strap 719 including a first quarter section 703 facing toward first floor section 540 and a second quarter section 704 mating with first quarter section 703 and facing toward second floor section 542. Second slot 619 is formed in the second quarter section 704 of each second axle mount 519.

First and second slots 617, 619 are in effect "one-way" slots to allow 90° of limited travel. As suggested in FIGS. 20–24, center floor elevator 511 can only rotate 90° with respect to first floor section 540 and 90° with respect to second floor section 542.

What is claimed is:

1. A foldable scaffold convertible between a use position and a folded position, the foldable scaffold comprising a floor configured to act as a support when the scaffold is in the use position, the floor including first and second floor sections coupled to pivot relative to one another to convert the scaffold between the use and folded positions, the first and second floor sections forming a support surface when the scaffold is in the use position and defining a cavity therebetween when the scaffold is in the folded position, a first leg coupled to the first floor section and a second leg coupled to the second floor section, the first and second legs being configured to support the floor at an elevated position when the scaffold is in the use position and to be received by the cavity when the scaffold is in the folded position, and at least one first leg mover link pivotably coupling the first floor section to the second leg and at least one second leg mover link pivotably connecting the second floor section to the first leg such that the first leg pivots inwardly relative to the first floor section and the second leg pivots inwardly relative to the second floor section as the first and second floor sections pivot relative to each other.

2. The foldable scaffold of claim 1, wherein the first floor section has a first serpentine mating edge and the second floor section has a second serpentine mating edge that mates with the first serpentine mating edge when the scaffold is converted to the use position.

3. The foldable scaffold of claim 1, wherein the first leg is coupled to the first floor section by at least one pivot pin and the second leg is coupled to the second floor section by at least one pivot pin.

4. The foldable scaffold of claim 1, wherein the first and second floor sections cooperate to form a handle when the scaffold is in the folded position.

5. The foldable scaffold of claim 1, further comprising a center leg disposed between the first and second legs and coupled to the floor, and wherein the center leg cooperates with the first and second legs to support the first and second floor sections at an elevated position when the scaffold is in the use position and is received by the cavity when the scaffold is in the folded position.

6. The foldable scaffold of claim 4, further comprising orientation means for maintaining the center leg in a position along the pivot axis bisecting an included angle between the first and second floor sections as the first and second floor sections pivot relative to one another about the pivot axis as the scaffold is converted between the use and folded positions.

7. A foldable scaffold convertible between a use position and a folded position, the foldable scaffold comprising a floor configured to act as a support when the scaffold is in the use position, the floor including first and second floor sections coupled to pivot relative to one another to convert the scaffold between the use and folded positions, the first and second floor sections forming a support surface when the scaffold is in the use position and defining a cavity therebetween when the scaffold is in the folded position, a first leg coupled to the first floor section and a second leg coupled to the second floor section, the first and second legs being configured to support the floor at an elevated position when the scaffold is in the use position and to be received by the cavity when the scaffold is in the folded position, and at least one first leg mover link pivotably coupling the first floor section to the second leg and at least one second leg mover link pivotably connecting the second floor section to the first leg such that the first leg pivots relative to the first floor section and the second leg pivots relative to the second floor section as the first and second floor sections pivot relative to each other, wherein the first and second floor sections cooperate to form a handle when the scaffold is in the folded position and the first floor section defines a hole, the second floor section defines a hole, and the two holes align when the scaffold is in the folded position to form the handle.

8. A foldable scaffold convertible between a use position and a folded position, the foldable scaffold comprising a floor including first and second floor sections coupled to pivot relative to one another to convert the scaffold between the use and folded positions, the first and second floor sections forming a support surface when the scaffold is in the use position and defining a cavity when the scaffold is in the folded position, a first leg coupled to the first floor section and a second leg coupled to the second floor section, the first and second legs being configured to support the floor at an elevated position when the scaffold is in the use position and to be received by the cavity when the scaffold is in the folded position, and a center leg coupled to the floor and disposed between the first and second legs, the center leg cooperating with the first and second legs to support the first and second floor sections at an elevated position when the scaffold is in the use position and being received by the cavity therebetween when the scaffold is in the folded position, wherein each of the first and second legs includes a bend defining a void and the center leg is received by the voids during pivoting of the first and second legs as the scaffold is converted between the use and folded positions.

9. A foldable scaffold convertible between a use position and a folded position, the foldable scaffold comprising a floor configured to act as a support when the scaffold is in the use position, the floor including first and second floor sections coupled to pivot relative to one another to convert the scaffold between the use and folded positions, the first and second floor sections forming a support surface when the scaffold is in the use position and defining a cavity therebetween when the scaffold is in the folded position, a first lea coupled to the first floor section and a second leg coupled to the second floor section, the first and second legs being configured to support the floor at an elevated position when the scaffold is in the use position and to be received by the cavity when the scaffold is in the folded position, at least one first leg mover link pivotably coupling the first floor section to the second leg and at least one second leg mover link pivotably connecting the second floor section to the first leg such that the first leg pivots relative to the first floor section and the second leg pivots relative to the second floor section as the first and second floor sections pivot relative to each other, and a center leg disposed between the first and second legs and coupled to the floor, and wherein the center leg cooperates with the first and second legs to support the first and second floor sections at an elevated position when the scaffold is in the use position and is received by the cavity when the scaffold is in the folded position, wherein the floor further includes a first axle mount coupled to the first floor section and formed to include a first axle-receiving space, a second axle mount coupled to the second floor section and formed to include a second axle-receiving space, and an axle arranged to extend through the first and second axle-receiving spaces to establish a pivot axis to allow the first and second floor sections to pivot relative to one another about the pivot axis, the center leg is coupled to one end of the axle and further comprising another center leg coupled to an opposite end of the axle to cooperate with the first, second, and center legs to support the first and second floor sections at an elevated position when the scaffold is in the use position and is received by the cavity when the scaffold is in the folded position.

10. The foldable scaffold of claim 9, wherein the first axle mount is formed to include a first slot, the second axle mount is formed to include a second slot, and the axle includes an axle rod coupled to the center legs and arranged to extend through the first and second axle-receiving spaces, a first rod post coupled to the axle rod and arranged to extend into the first slot and to move therein during pivoting movement of the first floor section relative to the second floor section, and a second rod post coupled to the axle rod and arranged to extend into the second slot and move therein during pivoting movement of the first floor section relative to the second floor section.

11. The foldable scaffold of claim 10, wherein the first axle mount includes a U-shaped strap including a first quarter section facing toward the first floor section and a second quarter section facing toward the second floor section, the first slot is formed in the first quarter section of the U-shaped strap of the first axle mount, the second axle mount includes a U-shaped strap including a first quarter section facing toward the first floor section and a second quarter section facing toward the second floor section, and the second slot is formed in the second quarter section of the second axle mount.

12. A foldable scaffold convertible between a use position and a folded position, the foldable scaffold comprising a floor configured to act as a support when the scaffold is in the use position, the floor including first and second floor sections coupled to pivot relative to one another to convert the scaffold between the use and folded positions, the first and second floor sections forming a support surface when the scaffold is in the use position and defining a cavity therebetween when the scaffold is in the folded position, a first leg coupled to the first floor section and a second leg coupled to the second floor section, the first and second legs being configured to support the floor at an elevated position when the scaffold is in the use position and to be received by the cavity when the scaffold is in the folded position, at least one first leg mover link pivotably coupling the first floor section to the second leg and at least one second leg mover link pivotably connecting the second floor section to the first leg such that the first leg pivots relative to the first floor section and the second leg pivots relative to the second floor section as the first and second floor sections pivot relative to each other, and a center leg disposed between the first and second legs and coupled to the floor, and wherein the center leg cooperates with the first and second legs to support the first and second floor sections at an elevated position when the scaffold is in the use position and is received by the cavity when the scaffold is in the folded position, wherein each of the first and second legs includes a bend defining a void and the center leg is received by the voids during pivoting of the first and second legs as the scaffold is converted between the use and folded positions.

13. A foldable scaffold convertible between a use position and a folded position, the foldable scaffold comprising a floor configured to act as a support when the scaffold is in the use position, the floor including first and second floor sections coupled to pivot relative to one another to convert the scaffold between the use and folded positions, the first and second floor sections forming a support surface when the scaffold is in the use position and defining a cavity therebetween when the scaffold is in the folded position, a first leg coupled to the first floor section and a second leg coupled to the second floor section, the first and second legs being configured to support the floor at an elevated position when the scaffold is in the use position and to be received by the cavity when the scaffold is in the folded position, at least one first leg mover link pivotably coupling the first floor section to the second leg and at least one second leg mover link pivotably connecting the second floor section to the first leg such that the first leg pivots relative to the first floor section and the second leg pivots relative to the second floor section as the first and second floor sections pivot relative to each other, and a center leg disposed between the first and second legs and coupled to the floor, and wherein the center leg cooperates with the first and second legs to support the first and second floor sections at an elevated position when the scaffold is in the use position and is received by the cavity when the scaffold is in the folded position, wherein the first floor section includes a bottom defining a channel for receiving the first leg when the scaffold is in the folded position and the second floor section includes a bottom defining a channel for receiving the second leg when the scaffold is in the folded position.

14. The foldable scaffold of claim 13, wherein each of the first and second legs includes a bend defining a void, the third leg is received by the voids during pivoting of the first and second legs as the scaffold is converted between the use and folded positions, and the channels include channel bends to receive the bends of the first and second legs when the scaffold is in the folded position.

15. A foldable scaffold convertible between a use position and a folded position, the foldable scaffold comprising a floor configured to act as a support when the scaffold is in the use position, the floor including first and second floor sections coupled to pivot relative to one another to convert the scaffold between the use and folded positions, the first and second floor sections forming a support surface when the scaffold is in the use position and defining a cavity therebetween when the scaffold is in the folded position, a first leg coupled to the first floor section and a second leg coupled to the second floor section, the first and second leas being configured to support the floor at an elevated position when the scaffold is in the use position and to be received by the cavity when the scaffold is in the folded position, and at least one first leg mover link pivotably coupling the first floor section to the second leg and at least one second leg mover link pivotably connecting the second floor section to the first lea such that the first lea pivots relative to the first floor section and the second leg pivots relative to the second floor section as the first and second floor sections pivot relative to each other, wherein the first floor section has a first serpentine mating edge and the second floor section has a second serpentine mating edge that mates with the first serpentine mating edge when the scaffold is converted to the use position and the floor further includes a first axle mount coupled to the first floor section and formed to include a first axle-receiving space, a second axle mount coupled to the second floor section and formed to include a second axle-receiving space, and an axle arranged to extend through the first and second axle-receiving spaces and across the first and second serpentine mating edges to couple the first floor section to the second floor section and establish a pivot axis to allow the first and second floor sections to pivot relative to one another about the pivot axis as the scaffold is converted between the use and folded positions.

16. The foldable scaffold of claim 15, wherein the first floor section has a body coupled to the first leg, the second floor section has a body coupled to the second leg, the first serpentine mating edge defines a peninsula extending from the body of the first floor section past the pivot axis toward the body of the second floor section, the second serpentine mating edge defines a peninsula extending from the body of the second floor section past the pivot axis toward the body of the first floor section, the second serpentine mating edge of the second floor section is arranged to mate with the first serpentine mating edge of the first floor section when the scaffold is converted to the use position to cause the peninsulas of the first and second floor sections to lie in side-by-side relation to one another, the first axle mount is coupled to the peninsula of the first floor section, the second axle mount is coupled to the peninsula of the second floor section, and the axle is arranged to extend across the peninsulas of the first and second floor sections.

17. A foldable scaffold convertible between a use position and a folded position, the foldable scaffold comprising a floor configured to act as a support when the scaffold is in the use position, the floor including first and second floor sections, a first axle mount coupled to the first floor section and formed to include a first axle-receiving space, a second axle mount coupled to the second floor section and formed to include a second axle-receiving space, an axle arranged to extend through the first and second axle-receiving spaces to couple the first floor section to the second floor section and establish a pivot axis to allow the first and second floor section to pivot relative to one another about the pivot axis as the scaffold is converted between the use and folded positions, a first leg pivotably coupled to the first floor section, a second leg pivotably coupled to the second floor section, and a center leg coupled to the axle and arranged to lie between the first and second floor sections upon movement of the scaffold to the folded position, wherein the first axle mount is formed to include a first slot, the second axle mount is formed to include a second slot, and the axle includes an axle rod coupled to the center leg and arranged to extend through the first and second axle-receiving spaces, a first rod post coupled to the axle rod and arranged to extend into the first slot and to move therein during pivoting movement of the first floor section relative to the second floor section, and a second rod post coupled to the axle rod and arranged to extend into the second slot and move therein during pivoting movement of the first floor section relative to the second floor section.

18. The foldable scaffold of claim 17, wherein the first axle mount includes a U-shaped strap including a first quarter section facing toward the first floor section and a second quarter section facing toward the second floor section, the first slot is formed in the first quarter section of the U-shaped strap of the first axle mount, the second axle mount includes a U-shaped strap including a first quarter section facing toward the first floor section and a second quarter section facing toward the second floor section, and the second slot is formed in the second quarter section of the second axle mount.

19. The foldable scaffold of claim 17, wherein the first floor section has a body coupled to the first leg and a first serpentine mating edge defining a peninsula extending from the body of the first floor section past the pivot axis toward the body of the second floor section, the second floor section has a body coupled to the second leg and a second serpentine mating edge defining a peninsula extending from the body of the second floor section past the pivot axis toward the body of the first floor section, the second serpentine mating edge of the second floor section is arranged to mate with the first serpentine mating edge of the first floor section when the scaffold is converted to the use position to cause the peninsulas of the first and second floor sections to lie in side-by-side relation to one another, the first axle mount is coupled to the peninsula of the first floor section, and the second axle mount is coupled to the peninsula of the second floor section.

20. The foldable scaffold of claim 17, wherein the first floor section has a first serpentine mating edge and the second floor section has a second serpentine mating edge that mates with the first serpentine mating edge when the scaffold is converted to the use position.

21. A foldable scaffold convertible between a use position and a folded position, the foldable scaffold comprising a floor configured to act as a support when the scaffold is in the use position, the floor including first and second floor sections, a first axle mount coupled to the first floor section and formed to include a first axle-receiving space, a second axle mount coupled to the second floor section and formed to include a second axle-receiving space, an axle arranged to extend through the first and second axle-receiving spaces to couple the first floor section to the second floor section and establish a pivot axis to allow the first and second floor section to pivot relative to one another about the pivot axis as the scaffold is converted between the use and folded positions, a first leg pivotably coupled to the first floor section, a second leg pivotably coupled to the second floor section, and a center leg coupled to the axle and arranged to lie between the first and second floor sections upon movement of the scaffold to the folded position, wherein the first floor section has a first serpentine mating edge and the second floor section has a second serpentine mating edge that mates with the first serpentine mating edge when the scaffold is converted to the use position and the first floor section includes a body coupled to the first leg and a center peninsula extending from the body of the first floor section and having a boundary defined by a portion of the first serpentine mating edge, the second floor section includes a body coupled to the second leg and a first peninsula extending from the body of the second floor section and having a boundary defined by a first portion of the second serpentine mating edge, the first axle mount is coupled to the center peninsula of the first floor section, and the second axle mount is coupled to the first peninsula of the second floor section.

22. The foldable scaffold of claim 21, wherein the second floor section further includes a second peninsula extending from the body of the second floor section and lying in spaced-apart position to the first peninsula to locate the center peninsula therebetween, the floor further includes an auxiliary second axle mount coupled to the second peninsula and formed to include another axle-receiving space, and the axle is arranged to extend through the axle-receiving space formed in the auxiliary second axle mount.

23. The foldable scaffold of claim 22, wherein the center leg is coupled to one end of the axle and further comprising another center leg coupled to an opposite end of the axle to cause the first, second, and auxiliary second axle mount to lie between the center legs coupled to the axle.

24. A foldable scaffold convertible between a use position and a folded position, the foldable scaffold comprising a floor configured to act as a support when the scaffold is in the use position, the floor including first and second floor sections, a first axle mount coupled to the first floor section and formed to include a first axle-receiving space, a second axle mount coupled to the second floor section and formed to include a second axle-receiving space, an axle arranged to extend through the first and second axle-receiving spaces to couple the first floor section to the second floor section and establish a pivot axis to allow the first and second floor section to pivot relative to one another about the pivot axis as the scaffold is converted between the use and folded positions, a first leg pivotably coupled to the first floor section, a second leg pivotably coupled to the second floor section, and a center leg coupled to the axle and arranged to lie between the first and second floor sections upon movement of the scaffold to the folded position, wherein the first floor section includes a body coupled to the first leg and a center peninsula arranged to extend from the body of the first floor section and coupled to the first axle mount and the second floor section includes a body coupled to the second leg and a first peninsula arranged to extend from the body of the second floor section and coupled to the second axle mount.

25. The foldable scaffold of claim 24, wherein the second floor section further includes a second peninsula extending from the body of the second floor section and lying in spaced-apart position to the first peninsula to locate the center peninsula therebetween, the floor further includes an auxiliary second axle mount coupled to the second peninsula and formed to include another axle-receiving space, and the axle is arranged to extend through the axle-receiving space formed in the auxiliary second axle mount.

26. The foldable scaffold of claim 25, wherein each of the first, second, and auxiliary second axle mounts is formed to include a post-receiving slot, and the axle includes an axle rod coupled to the center leg and arranged to extend through the axle-receiving space formed in each of the first, second, and auxiliary second axle mounts, a first rod post coupled to the axle rod and arranged to extend into the post-receiving slot of the first axle mount, a second rod post coupled to the axle rod and arranged to extend into the post-receiving slot of the second axle mount, and a third rod post coupled to the axle rod and arranged to extend into the post-receiving slot of the auxiliary second axle mount.

27. A foldable scaffold convertible between a use position and a folded position, the foldable scaffold comprising a floor configured to act as a support when the scaffold is in the use position, the floor including first and second floor sections coupled to pivot relative to one another as the scaffold is converted between the use and folded positions, the first and second floor sections forming a support surface when the scaffold is in the use position and defining a cavity therebetween when the scaffold is in the folded position, first and second legs configured to support the first and second floor sections at an elevated position when the scaffold is in the use position and to be received by the cavity when the scaffold is in the folded position, means for pivotably coupling the first and second legs to the floor such that the first and second legs pivot relative to the floor as the first and second sections pivot relative to each other, and a center leg disposed between the first and second legs and coupled to the floor, the center leg cooperating with the first and second legs to support the floor at an elevated position when the scaffold is in the use position and to be received by the cavity when the scaffold is in the folded position, wherein the means for pivotably coupling the first and second legs to the floor comprises a pair of first leg mover links pivotably connecting the second floor section to the first leg and a pair of second leg mover links pivotably connecting the first floor section to the second leg, and the first and second leg mover links are configured to pivot relative to the floor as the first and second floor sections pivot relative to each other.

28. The foldable scaffold of claim 27 wherein the means for pivotably coupling the first and second legs to the floor further comprises at least one first pivot pin connecting the first leg with the first floor section and at least one second pivot pin connecting the second leg with the second floor section.

29. The foldable scaffold of claim 28, wherein the means for pivotably coupling the first and second legs to the floor comprises a plurality of pivot pins connecting the first leg to the first floor section and the second leg to the second floor section.

* * * * *